US009650836B2

(12) United States Patent
Scott et al.

(10) Patent No.: US 9,650,836 B2
(45) Date of Patent: May 16, 2017

(54) CUTTING ELEMENTS LEACHED TO DIFFERENT DEPTHS LOCATED IN DIFFERENT REGIONS OF AN EARTH-BORING TOOL AND RELATED METHODS

(71) Applicant: Baker Hughes Incorporated, Houston, TX (US)

(72) Inventors: Danny E. Scott, Montgomery, TX (US); Anthony A. DiGiovanni, Houston, TX (US); Nicholas J. Lyons, Rio de Janeiro (BR); Derek L. Nelms, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 299 days.

(21) Appl. No.: 13/783,118

(22) Filed: Mar. 1, 2013

(65) Prior Publication Data

US 2014/0246251 A1 Sep. 4, 2014

(51) Int. Cl.
*E21B 10/567* (2006.01)
*E21B 10/573* (2006.01)

(52) U.S. Cl.
CPC ..... *E21B 10/567* (2013.01); *E21B 10/5735* (2013.01)

(58) Field of Classification Search
CPC ..... E21B 10/46; E21B 10/56; E21B 10/567
See application file for complete search history.

(56) References Cited

U.S. PATENT DOCUMENTS

| | | | | |
|---|---|---|---|---|
| 5,605,198 | A | 2/1997 | Tibbitts et al. | |
| 5,787,022 | A | 7/1998 | Tibbitts et al. | |
| 5,950,747 | A | 9/1999 | Tibbitts et al. | |
| 6,021,859 | A | 2/2000 | Tibbitts et al. | |
| 8,061,454 | B2 | 11/2011 | Voronin et al. | |
| 2005/0247486 | A1* | 11/2005 | Zhang et al. | 175/57 |
| 2010/0155149 | A1 | 6/2010 | Keshavan et al. | |
| 2011/0061944 | A1 | 3/2011 | Scott et al. | |
| 2011/0259648 | A1* | 10/2011 | Sani | 175/428 |
| 2012/0111642 | A1* | 5/2012 | Digiovanni | 175/428 |

(Continued)

FOREIGN PATENT DOCUMENTS

| | | | |
|---|---|---|---|
| EP | 1191001 | A2 | 3/2002 |
| WO | 2010135605 | A2 | 11/2010 |
| WO | 2012177735 | A2 | 12/2012 |

OTHER PUBLICATIONS

DiGiovanni et al., U.S. Appl. No. 13/472,377, entitled Cutting Elements for Earth-Boring Tools, Earth-Boring Tools Including Such Cutting Elements and Related Methods, Filed May 15, 2012.

(Continued)

*Primary Examiner* — Brad Harcourt
(74) *Attorney, Agent, or Firm* — TraskBritt

(57) ABSTRACT

Earth-boring tools may comprise a body comprising a first region and a second region. The first region may be located closer to a rotational axis of the body than the second region. A first cutting element may be located in the first region and a second cutting element may be located in the second region. A first polycrystalline table of the first cutting element may be substantially free of catalyst material to a first depth and a second polycrystalline table of the second cutting element may be substantially free of catalyst material to a second, greater depth.

10 Claims, 5 Drawing Sheets

(56) References Cited

U.S. PATENT DOCUMENTS

| | | | |
|---|---|---|---|
| 2012/0222364 | A1 | 9/2012 | Lyons et al. |
| 2012/0225253 | A1 | 9/2012 | DiGiovanni et al. |
| 2012/0225277 | A1 | 9/2012 | Scott |

OTHER PUBLICATIONS

DiGiovanni, Anthony A., U.S. Appl. No. 13/609,575, entitled Cutting Elements for Earth-Boring Tools, Earth-Boring Tools Including Such Cutting Elements and Related Methods, filed Sep. 11, 2012.
International Search Report for International Application No. PCT/US2014/019380 dated Jun. 24, 2014, 3 pages.
International Written Opinion for International Application No. PCT/US2014/019380 dated Jun. 24, 2014, 9 pages.
International Preliminary Report on Patentability for International Application No. PCT/US2014/019380, dated Sep. 1, 2015, 10 pages.
Chinese Office Action and Search Report for Chinese Application No. 2014800116735 dated Sep. 21, 2016, 11 pages.
European Search Report for European Application No. 14757765.4 dated Nov. 7, 2016, 8 pages.

* cited by examiner

CUTTING ELEMENTS LEACHED TO DIFFERENT DEPTHS LOCATED IN DIFFERENT REGIONS OF AN EARTH-BORING TOOL AND RELATED METHODS

FIELD

The disclosure relates generally to earth-boring tools and placement of cutting elements on earth-boring tools. More specifically, disclosed embodiments relate to earth-boring tools including cutting elements leached to different depths located in different regions of the earth-boring tools.

BACKGROUND

Generally, earth-boring tools having fixed cutting elements at leading ends of the earth-boring tools, such as, for example, fixed-cutter drill bits and hybrid drill bits, may include a body having blades extending from the body. A crown of such an earth-boring tool at a leading end thereof may be defined by a cone region at and around a rotational axis, which may also be a central axis, of the tools, a nose region adjacent to and surrounding the cone region, a shoulder region adjacent to and surrounding the nose region, and a gage region at a periphery of the tool. Cutting elements may be secured to the blades at rotationally leading portions of the blades along the cone, nose, shoulder, and gage regions to engage with and remove an underlying earth formation as the earth-boring tool is rotated. Such cutting elements may comprise a polycrystalline table of superhard material, such as, for example, diamond, secured to a substrate of hard material, such as, for example, cemented tungsten carbide. The cutting elements may be secured within pockets formed in the blades, such as, for example, by brazing.

After formation, the polycrystalline tables may include catalyst material, such as, for example, cobalt, that was used to catalyze formation of inter-granular bonds between particles of the superhard material, which catalyst material may be located in interstitial spaces among interbonded grains of the superhard material. The catalyst material may be removed, such as, for example, by leaching using acid, to reduce the likelihood that differences in rates of thermal expansion between the superhard material and the catalyst material will cause cracks to form in the polycrystalline table, which may ultimately lead to chipping and premature failure of the polycrystalline table.

To further reduce the likelihood that cutting elements will prematurely fail, the types of cutting elements in different regions of the earth-boring tool may be specifically engineered to accommodate certain types of loading experienced in those regions during drilling, as disclosed in U.S. Pat. No. 5,787,022, issued Jul. 28, 1998, to Tibbitts et al., the disclosure of which is incorporated herein in its entirety by this reference. For example, the '022 patent discloses that cutting elements in the cone and nose regions may be engineered to withstand high axial and combined axial and tangential loading, and cutting elements in the shoulder and gage regions may be engineered to withstand high tangential loading. The '022 patent further discloses that cutting element design and placement may minimize and stabilize cutting element temperatures, such as, for example, by providing cutting elements in the shoulder region with internal hydraulic cooling or enhanced heat transfer characteristics.

BRIEF SUMMARY

In some embodiments, earth-boring tools comprise a body comprising a crown at a leading end of the body, the crown comprising a first region and a second region. The first region is located closer to a rotational axis of the body than the second region. A first cutting element located in the first region is secured to the body, the first cutting element comprising a first polycrystalline table secured to a first substrate. A second cutting element located in the second region is also secured to the body, the second cutting element comprising a second polycrystalline table secured to a second substrate. Each of the first polycrystalline table and the second polycrystalline table comprises interbonded grains of superhard material. The first polycrystalline table is substantially free of catalyst material to a first depth and the second polycrystalline table is substantially free of catalyst material to a second, greater depth.

In other embodiments, earth-boring tools may comprise a body comprising a crown at a leading end of the body. The crown may comprise a cone region at and around a rotational axis of the body, a nose region adjacent to and surrounding the cone region, a shoulder region adjacent to and surrounding the nose region, and a gage region defining a periphery of the body adjacent to and surrounding the shoulder region. A first cutting element located in the cone region may be secured to the body. The first cutting element may comprise a first polycrystalline table secured to a first substrate. A second cutting element located in the shoulder region may be secured to the body. The second cutting element may comprise a second polycrystalline table secured to a second substrate. Each of the first polycrystalline table and the second polycrystalline table may comprise interbonded grains of superhard material. The first polycrystalline table may be substantially free of catalyst material to a first depth and the second polycrystalline table may be substantially free of catalyst material to a second, greater depth.

In yet other embodiments, earth-boring tools may comprise a body comprising a crown at a leading end of the body. The crown may comprise a cone region at and around a rotational axis of the body, a nose region adjacent to and surrounding the cone region, a shoulder region adjacent to and surrounding the nose region, and a gage region defining a periphery of the body adjacent to and surrounding the shoulder region. Cutting elements located in each of the cone region, the nose region, the shoulder region, and the gage region may be secured to the body. Each cutting element may comprise a polycrystalline table secured to a substrate. The polycrystalline table of each cutting element may comprise interbonded grains of superhard material. Each polycrystalline table of each cutting element is substantially free of catalyst material to a depth, the depth increasing with distance from the rotational axis from the cone region to the shoulder region.

In still other embodiments, methods of forming earth-boring tools may comprise providing a first cutting element and a second cutting element, the first cutting element comprising a first polycrystalline table secured to a first substrate, the second cutting element comprising a second polycrystalline table secured to a second substrate, wherein each of the first polycrystalline table and the second polycrystalline table comprises interbonded grains of superhard material. Catalyst material used to catalyze formation of inter-granular bonds among the grains of superhard material may be removed from the first polycrystalline table to a first depth and from the second polycrystalline table to a second, greater depth. A body comprising a crown at a leading end of the body, the crown comprising a first region and a second region, the first region being located closer to a rotational axis of the body than the second region may be provided. The first cutting element may be secured to the body in the first region, and the second cutting element may be secured to the body in the second region.

BRIEF DESCRIPTION OF THE DRAWINGS

While the disclosure concludes with claims particularly pointing out and distinctly claiming embodiments encompassed by the disclosure, various features and advantages of embodiments within the scope of the disclosure may be more readily ascertained from the following description when read in conjunction with the accompanying drawings, in which:

DETAILED DESCRIPTION

Figure 1:
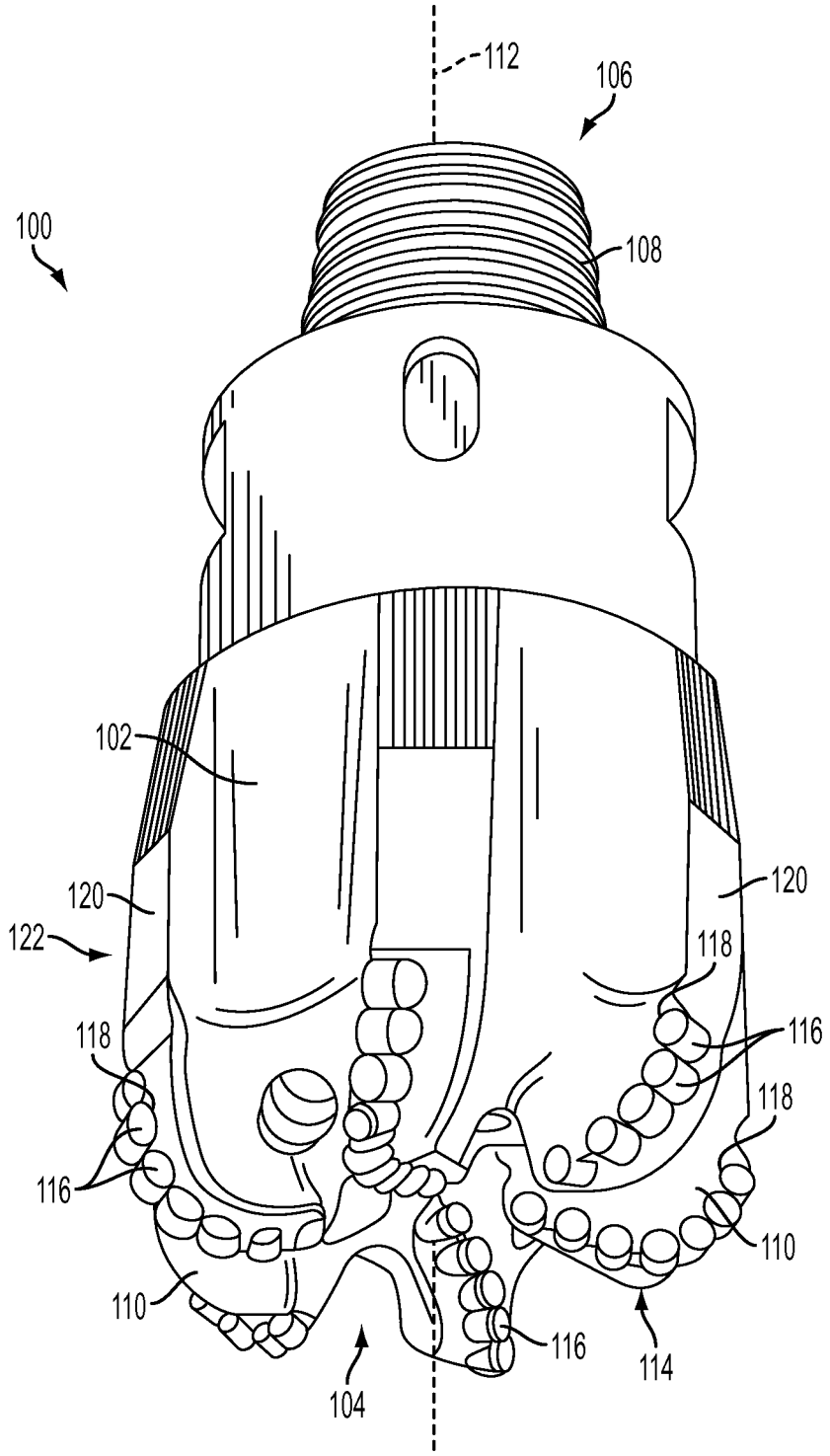
FIG. 1 is a perspective view of an earth-boring tool.

The illustrations presented herein are not meant to be actual views of any particular earth-boring tool, cutting element, or component thereof, but are merely idealized representations employed to describe illustrative embodiments. Thus, the drawings are not necessarily to scale.

Disclosed embodiments relate generally to earth-boring tools including cutting elements leached to different depths located in different regions of the earth-boring tools. More specifically, disclosed are embodiments of earth-boring tools that may be better tailored to a given set of use conditions, including formation to be drilled, depth of a wellbore, expected cost of operations, and expected value of the well, and which may enable a designer to tailor the cutting elements secured to and distributed over the leading end of an earth-boring tool to have a more uniform service life.

As used herein, the term "earth-boring tool" means and includes any type of bit or tool having fixed cutting elements secured to the bit or tool at a leading end thereof used for drilling during the creation or enlargement of a wellbore in a subterranean formation. For example, earth-boring tools include fixed-cutter bits, percussion bits, core bits, eccentric bits, bicenter bits, mills, drag bits, hybrid bits, and other drilling bits and tools known in the art.

As used herein, the terms "polycrystalline table" and "polycrystalline material" mean and include any structure or material comprising grains (e.g., crystals) of a material (e.g., a superabrasive material) that are bonded directly together by inter-granular bonds. The crystal structures of the individual grains of the material may be randomly oriented in space within the polycrystalline table. For example, polycrystalline tables include polycrystalline diamond compacts (PDCs) characterized by diamond grains that are directly bonded to one another to form a matrix of diamond material with interstitial spaces among the diamond grains.

As used herein, the term "inter-granular bond" and "inter-bonded" mean and include any direct atomic bond (e.g., covalent, metallic, etc.) between atoms in adjacent grains of superabrasive material.

As used herein, the term "superhard" means and includes any material having a Knoop hardness value of about 3,000 $Kg_f/mm^2$ (29,420 MPa) or more. Superhard materials include, for example, diamond and cubic boron nitride. Superhard materials may also be characterized as "superabrasive" materials.

As used herein, the term "substantially completely removed" when used in connection with removal of catalyst material from a polycrystalline material means and includes removal of substantially all catalyst material accessible by known catalyst removal processes. For example, substantially completely removing catalyst material includes leaching catalyst material from all accessible interstitial spaces of a polycrystalline material by immersing the polycrystalline material in a leaching agent (e.g., aqua regia) and permitting the leaching agent to flow through the network of interconnected interstitial spaces until all accessible catalyst material has been removed. Catalyst material located in isolated interstitial spaces, which are not connected to the rest of the network of interstitial spaces and are not accessible without damaging or otherwise altering the polycrystalline material, may remain.

Referring to FIG. 1, a perspective view of an earth-boring tool 100 is shown. The particular earth-boring tool 100 shown may be characterized as, for example, a fixed-cutter drill bit (e.g., a drag bit). The earth-boring tool 100 may comprise a body 102 having a leading end 104 and a trailing end 106. At the trailing end 106, the body 102 may comprise a connection member 108 (e.g., an American Petroleum Institute (API) threaded connection) configured to connect the earth-boring tool 100 to a drill string. At the leading end 104, the body 102 may include blades 110 extending axially outwardly from a remainder of the body 102 and radially outwardly from a rotational axis 112, which may also be a central axis, of the body 102 across the leading end 104. A crown 114 of the body 102 of the earth-boring tool 100 may comprise an outer surface defined by the blades 110 and the remainder of the body 102 at the leading end of the body 102. Cutting elements 116 may be secured to the body 102. For example, the cutting elements 116 may be partially located in pockets 118 formed in rotationally leading surfaces of the blades 110 and brazed to the surfaces of the blades 110 defining the pockets 118 to secure the cutting elements 116 to the body 102. The cutting elements 116 may be distributed over the crown 114 to form a cutting structure configured to engage with and remove an underlying earth formation as the earth-boring tool 100 is rotated during use. Gage pads 120 may be located at a periphery 122 of the body 102 and may define a radially outermost portion of the earth-boring tool 100 in some embodiments. In other embodiments, additional cutting elements 116 may be secured to the body 102 at the periphery 122 to define the radially outermost portion of the earth-boring tool 100.

Figure 2:
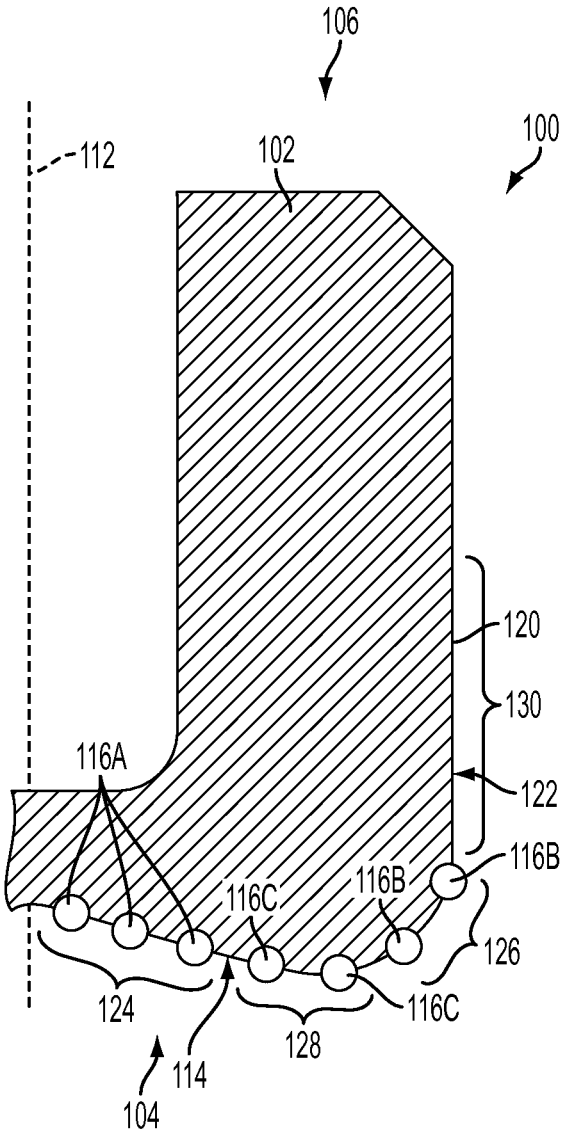
FIG. 2 is a cross-sectional view of a portion of the earth-boring tool of FIG. 1.

Referring to FIG. 2, a cross-sectional view of a portion of the earth-boring tool 100 of FIG. 1 is shown. The crown 114 may be defined by a series of regions extending radially outwardly from the rotational axis 112 of the body 102 to the periphery 122. For example, the crown 114 may be defined by a first, cone region 124 located at and immediately surrounding the rotational axis 112. The cone region 124 may be characterized by a sloping surface extending downwardly (when the rotational axis 112 is oriented vertically with the leading end 104 facing down) located at and immediately surrounding the rotational axis 112, which may generally resemble an inverted cone shape. A second, shoulder region 126 may be located radially outward from the cone region 124 adjacent the periphery 122 of the body 102. The shoulder region 126 may be characterized by a rounded, upwardly curving surface transitioning to the periphery 122 of the body 102. A third, nose region 128 may be interposed between and adjacent to both the cone region 124 and the shoulder region 126. The nose region 128 may be characterized by a transition from the sloping surface of the cone region 124 curving toward horizontal and beginning to curve upwardly into the shoulder region 126. A fourth, gage region 130 may be located radially outward from and adjacent to the shoulder region 126 and may define the periphery 122 of the body 102.

Cutting elements 116 may be distributed radially across at least a portion of the crown 114 at the leading end 104 of the body 102. For example, a first cutting element or set of cutting elements 116A may be located in the cone region 124. A second cutting element or set of cutting elements 116B may be located in the shoulder region 126. A third cutting element or set of cutting elements 116C may be located in the nose region 128. In some embodiments, the gage region 130 may be free of cutting elements 116. In other embodiments, a fourth cutting element or set of cutting elements may be located in the gage region 130. In some embodiments, the cutting elements 116 may be limited to cutting elements located at the rotationally leading face of a blade 110, as shown in FIG. 1. In other embodiments, the cutting elements 116 may include backup cutting elements rotationally trailing leading cutting elements secured to the same blade 110.

Drilling conditions in the different regions 124, 126, 128, and 130 may significantly differ from one another. For example, cutting elements 116A in the cone region 124 may be subjected to high axial forces (i.e., forces acting in a direction parallel to the rotational axis 112 of the earth-boring tool 100) resulting from the weight forcing the earth-boring tool 100 toward the underlying earth formation (e.g., weight-on-bit (W.O.B.)) or a combination of high axial forces and high tangential forces (i.e., forces acting in a direction perpendicular to the rotational axis 112 of the earth-boring tool 100) resulting from engagement of the cutting elements 116A with the underlying earth formation, may traverse relatively short helical cutting paths with each rotation of the bit 100, and may have a high depth of cut and correspondingly high efficiency. Cutting elements 116B in the shoulder region 126, by contrast, may be subjected to low axial forces and high tangential forces, may traverse relatively long helical cutting paths with each rotation of the bit 100, and may have a low depth of cut and correspondingly low efficiency. Cutting elements 116C in the nose region 128 may experience use conditions intermediate those present in the cone region 124 and shoulder region 126. Cutting elements in the gage region 130 may not be subjected to significant axial forces, may traverse relatively long helical paths with each rotation of the bit 100, and may have a low depth of cut and correspondingly low efficiency. Such differences in drilling conditions produce stresses at different levels and oriented in different directions and operational temperatures at different intensities in the cutting elements 116A, 116B, and 116C in different regions 124, 126, 128, and 130 of the earth-boring tool 100.

Figure 3:
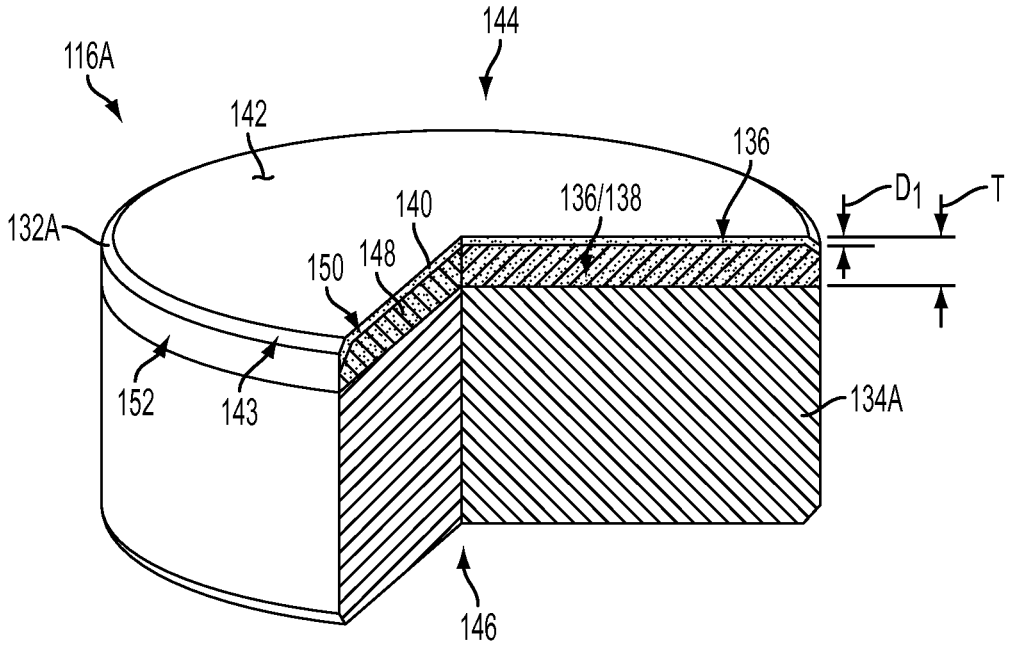
FIG. 3 is a perspective partial cross-sectional view of a cutting element from a first region of the earth-boring tool of FIGS. 1 and 2.

Referring to FIG. 3, a perspective partial cross-sectional view of a cutting element 116A from the first, cone region 124 of the earth-boring tool 100 of FIGS. 1 and 2 is shown. The cutting element 116A may comprise a polycrystalline table 132A secured to a substrate 134A. For example, the cutting element 116A may comprise a disk-shaped polycrystalline table 132A in contact with a generally planar surface at an end of a cylindrical substrate 134A and attached to the substrate 134A. Of course, many variations to the general structure of the cutting element 116A may be made, as known in the art, such as, for example, forming the interface between the polycrystalline table 132A and the substrate 134A to be non-planar and shaping the cutting element to be non-cylindrical (e.g., an elliptical cylinder). The substrate 134A may comprise a hard material suitable for use in earth-boring applications. For example, the substrate 134A may comprise a ceramic-metallic composite material (i.e., a cermet) comprising particles of hard ceramic material (e.g., tungsten carbide) in a continuous, metal binder material (e.g., cobalt). The polycrystalline table 132A may comprise a polycrystalline material 136 characterized by grains of a superhard material (e.g., synthetic, natural, or a combination of synthetic and natural diamond, cubic boron nitride, etc.) that have bonded to one another to form a matrix of polycrystalline material 136 with interstitial spaces located among interbonded grains of the superhard material.

Such a cutting element may be formed, for example, by placing particles (e.g., in powder form or mixed with a liquid to form a paste) of superhard material in a container. The particles may be mixed with particles of catalyst material or located adjacent a mass (e.g., a foil or disk) of catalyst material in some embodiments. Suitable catalyst materials may include, for example, metals from Group VIIIA of the periodic table of the elements, such as, nickel, cobalt, and iron, and alloys including such metals. In some embodiments, a preformed substrate 134A may be placed in the container along with the particles of superhard materials. In other embodiments, precursor materials, such as particles of hard material (e.g., tungsten carbide) and particles of metal binder material (e.g., cobalt) may be placed in the container along with the particles of superhard materials. In either case, the metal binder material may also be a catalyst material used to catalyze formation of inter-granular bonds between the particles of superhard material. In still other embodiments, the particles of superhard material and catalyst material may be alone in the container, with no substrate or substrate precursor materials being located therein. The particles may exhibit a mono-modal or multi-modal (e.g., bi-modal, tri-modal, etc.) particle size distribution. In some embodiments, particles of different average sizes may be positioned in different regions of the container. For example, particles of smaller average size may be positioned in a layer proximate an end of the container configured to form a cutting face of a cutting element or may be interposed between regions of particles of larger average size configured to form sandwiched layers.

The particles of superhard material and any substrate 134A or substrate precursor material may be sintered to form the polycrystalline table 132A. More specifically, the particles of superhard material and any substrate 134A or substrate precursor material may be subjected to a high-temperature/high-pressure (HTHP) process, during which the catalyst material may melt to flow and be swept among the particles of superhard material. Exposure to the catalyst material in HTHP conditions may cause some of the particles of superhard material to grow and interbond with one another (the total volume may remain constant), forming the polycrystalline table 132A. The resulting microstructure of the polycrystalline table 132A may be characterized by a matrix of interbonded grains of the superhard material (i.e., a polycrystalline material 136) with a matrix of interstitial spaces among the polycrystalline material 136. Catalyst material 138 may occupy the interstitial spaces. The polycrystalline table 132A may be secured to the substrate 134A by a metallurgical bond between the catalyst material within the polycrystalline table 132A and the matrix material of the substrate 134A, by atomic bonds between the grains of superhard material of the polycrystalline table 132A and the particles of hard material of the substrate 134A, by brazing the polycrystalline table 132A to a separately formed substrate 134A, or by any other techniques known in the art.

Subsequently, the catalyst material 138 may be substantially completely removed from a portion 140 of the polycrystalline table 132A at and adjacent an exterior surface of the polycrystalline table 132A to a first depth $D_1$ in some embodiments. For example, the catalyst material 138 may be substantially completely removed from a portion 140 extending from a cutting surface 142 at a rotationally leading end 144 of the cutting element 116A axially toward a rotationally trailing end 146 of the cutting element 116A. In some embodiments, the particle size of superhard particles used to form the polycrystalline table 132A may influence (e.g., control or enable greater predictability) the depth $D_1$ to which catalyst material is removed. For example, the particle size of superhard particles used to form the polycrystalline table 132A may be varied and the removal depth $D_1$ may be controlled in the ways disclosed in U.S. patent application Ser. No. 13/040,921, filed Mar. 4, 2011, on behalf of Lyons et al., and U.S. patent application Ser. No. 13/040,900, filed Mar. 4, 2011, on behalf of Scott, the disclosure of each of which is incorporated herein in its entirety by this reference. Accordingly, the polycrystalline table 132A may include a first portion 140 from which catalyst material 138 has been substantially completely removed and a second portion 148 in which the catalyst material 138 remains. In some embodiments, the catalyst material that was originally used to catalyze formation of the inter-granular bonds among grains of superhard material to form the polycrystalline table 132A may have been replaced by another catalyst material 138, which is then removed from the first portion 140.

An interface 150 between the first and second portions 140 and 148 may be at least substantially planar, extending at least substantially parallel to the cutting surface 142 in embodiments where the cutting surface 142 is planar. In some embodiments, the cutting surface 142, and the resulting interface 150, may be non-planar. For example, in embodiments where the polycrystalline table 132A includes a chamfer 143, the shape of the remaining catalyst material 138 may follow the contour of the chamfer 143. As another example, the cutting surface 142 may be formed with any of the shapes disclosed in U.S. patent application Ser. No. 13/472,377, filed May 15, 2012, now U.S. Pat. No. 9,482,057, issued Nov. 1, 2016, for "CUTTING ELEMENTS FOR EARTH-BORING TOOLS, EARTH-BORING TOOLS INCLUDING SUCH CUTTING ELEMENTS AND RELATED METHODS," and U.S. patent application Ser. No. 13/609,575, filed Sep. 11, 2012, now U.S. Pat. No. 9,103,174, issued Aug. 11, 2015, for "CUTTING ELEMENTS FOR EARTH-BORING TOOLS, EARTH-BORING TOOLS INCLUDING SUCH CUTTING ELEMENTS AND RELATED METHODS," the disclosure of each of which is incorporated herein in its entirety by this reference. In some embodiments, the catalyst material 138 may also be substantially completely removed such that the first portion extends radially inwardly from a periphery 152 of the polycrystalline table 132A (see FIG. 5). Removal of the catalyst material 138 may be accomplished, for example, by leaching (e.g., by submerging the first portion 140 of the polycrystalline table 132A in a leaching agent, such as, for example, aqua regia), by electro-chemical processes, or other catalyst removal techniques known in the art.

The first depth $D_1$ may be less than an entire thickness T of the polycrystalline table 132A. For example, the first depth $D_1$ may be less than about 75%, less than about 50%, less than about 25%, less than about 10%, or less than about 5% of the entire thickness T of the polycrystalline table 132A. More specifically, the first depth $D_1$ may be about 250 μm or less, about 100 μm or less, about 90 μm or less, about 50 μm or less, about 40 μm or less, about 30 μm or less, or about 20 μm or less.

Figure 4:
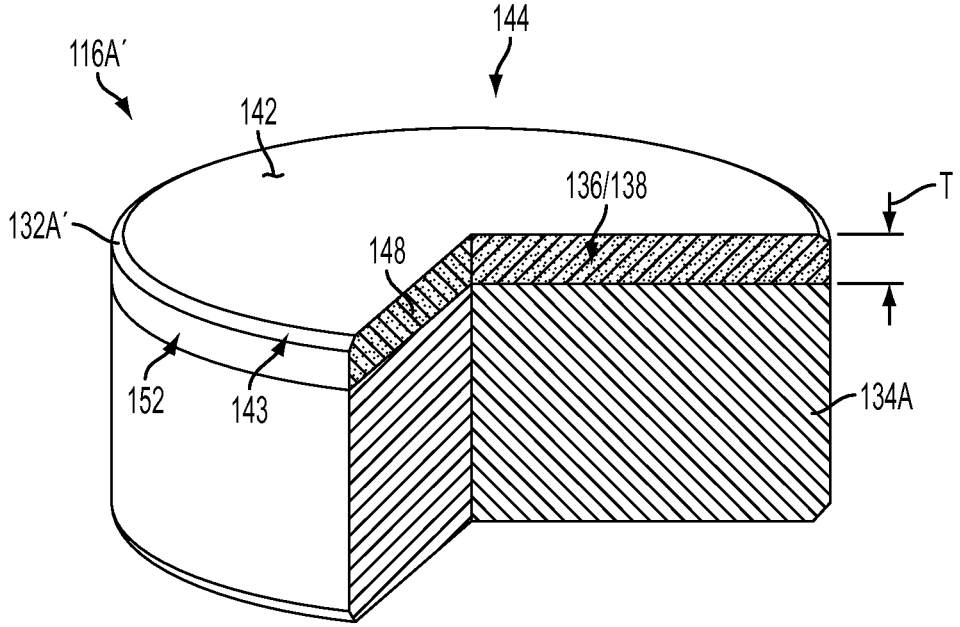
FIG. 4 is a perspective partial cross-sectional view of another embodiment of a cutting element from the first region of the earth-boring tool of FIGS. 1 and 2.

In some embodiments, the first depth $D_1$ may be zero. For example, and with reference to FIG. 4, a perspective partial cross-sectional view of another embodiment of a cutting element 116A' from the first, cone region 124 of the earth-boring tool 100 of FIGS. 1 and 2 is shown. In some embodiments, such as that shown in FIG. 4, the catalyst material 138 used to form the polycrystalline material 136 of a polycrystalline table 132A' may remain unaltered (e.g., unleached). In such embodiments, the first depth $D_1$ (see FIG. 3) may be zero, the first portion 140 (see FIG. 3) may be absent, and the second portion 148 may occupy an entire volume of the polycrystalline table 132A'.

Figure 5:
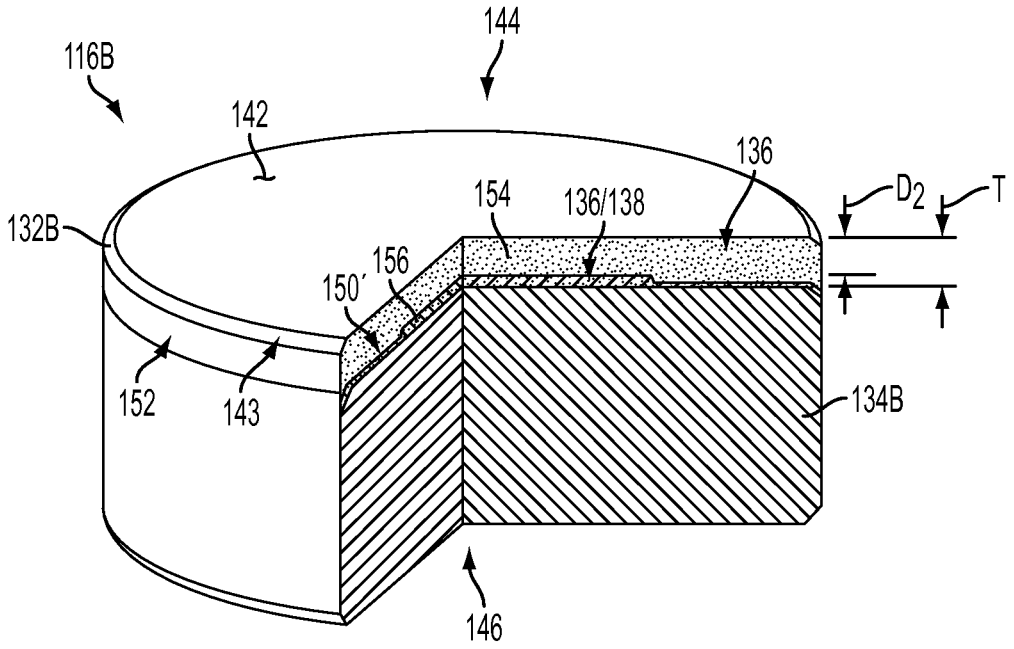
FIG. 5 is a perspective partial cross-sectional view of a cutting element from a second region of the earth-boring tool of FIGS. 1 and 2.

Referring to FIG. 5, a perspective partial cross-sectional view of a cutting' element 116B from the second, shoulder region 126 of the earth-boring tool 100 of FIGS. 1 and 2 is shown. The cutting element 116B may comprise a similar structure to the cutting element 116A and may be formed using the processes described previously in connection with FIG. 3, and a polycrystalline table 132B may have a similar resulting microstructure after formation. More specifically, the cutting element 116B may be similar in structure to the cutting element 116A of FIG. 3, except that catalyst material 138 may be substantially completely removed from a portion 154 of the polycrystalline table 132B at and adjacent an exterior of the polycrystalline table to a second depth $D_2$ in some embodiments. For example, the catalyst material 138 may be substantially completely removed from a portion 154 extending axially from a cutting surface 142 at a rotationally leading end 144 of the cutting element 116B toward a rotationally trailing end 146 of the cutting element 116B and extending radially inward from a periphery 152 of the polycrystalline table 132B. Accordingly, the polycrystalline table 132B may include a first portion 154 from which catalyst material 138 has been substantially completely removed and a second portion 156 in which the catalyst material 138 remains. An interface 150' between the first and second portions 154 and 156 may exhibit an inverted "U" shaped cross-sectional shape. More specifically, the first portion 154 may extend axially from the cutting surface 142 toward the substrate 134B to the second depth $D_2$ and may also extend radially from the periphery 152 toward the second portion 156 to the second depth $D_2$. At least some catalyst material 138 immediately adjacent the substrate 134B may extend entirely to the periphery 152, with the inverted "U" shaped structure extending toward the cutting surface 142 from a remainder of the catalyst material 138 in some embodiments. In some embodiments, the catalyst material 138 may only be substantially completely removed such that the first portion extends axially downward from the cutting surface 142 of the polycrystalline table 132A (see FIG. 3). Removal of the catalyst material 138 may be accomplished, for example, by leaching (e.g., by submerging the first portion 140 of the polycrystalline table 132A in a leaching agent, such as, for example, aqua regia) or other catalyst removal techniques known in the art.

The second depth $D_2$ may be greater than the first depth $D_1$, up to an entire thickness T of the polycrystalline table 132B. Removing the catalyst material 138 to different depths $D_1$ and $D_2$ for different cutting elements 116A and 116B to be located in different regions 124 and 126 (see FIG. 2) of an earth-boring tool 100 (see FIGS. 1 and 2) may be accomplished, for example, by using leaching agents of different strengths, exposing the polycrystalline tables 132A and 132B to the leaching agents for different lengths of time and at different temperatures, coating portions of the cutting elements 116A and 116B with protective materials to different extents (e.g., corresponding to the desired depths $D_1$ and $D_2$), or any combination of these. The second depth $D_2$ may be greater than the first depth $D_1$ and, for example, greater than about 25%, greater than about 50%, greater than about 75%, greater than about 90%, or greater than about 95% of the entire thickness T of the polycrystalline table 132B. More specifically, the second depth $D_2$ may be greater than the first depth $D_1$ and be about 100 μm or more, about 200 μm or more, about 250 μm or more, about 300 μm or more, about 500 μm or more, about 650 μm or more, or about 800 μm or more. A ratio of the first depth $D_1$ to the second depth $D_2$ may be about 1:2 or greater, about 1:5 or greater, about 1:10 or greater, about 1:25 or greater, about 1:50 or greater, or about 1:100 or greater.

Figure 6:
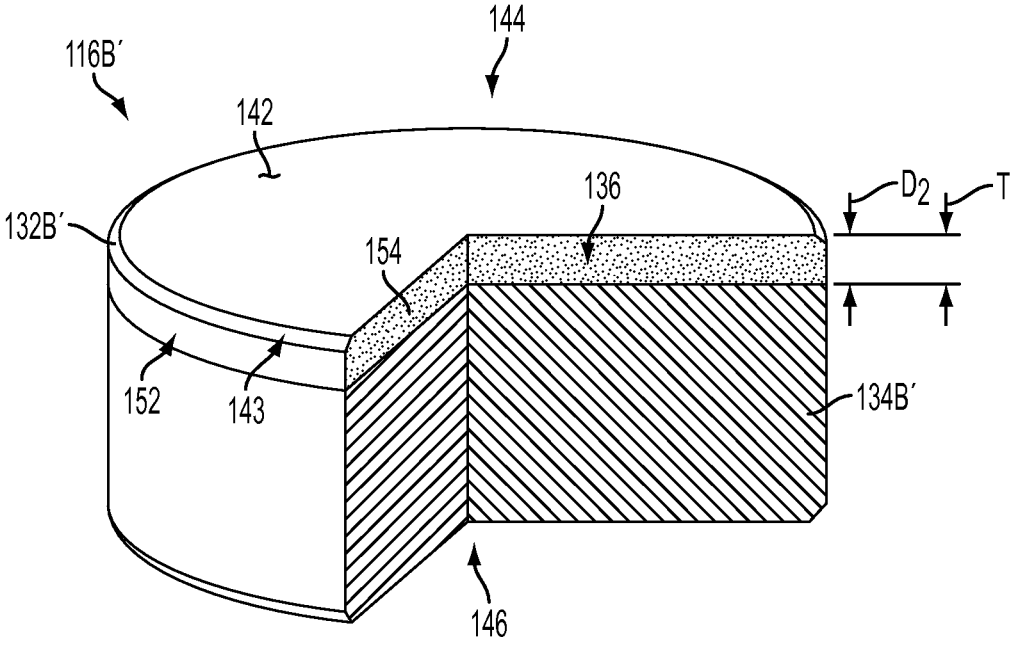
FIG. 6 is a perspective partial cross-sectional view of another embodiment of a cutting element from the second region of the earth-boring tool of FIGS. 1 and 2.

The second depth $D_2$ may be the entire thickness T of the polycrystalline table 132B in some embodiments. For example, and with reference to FIG. 6, a perspective partial cross-sectional view of another embodiment of a cutting element 116W from the second, shoulder region 126 of the earth-boring tool 100 of FIGS. 1 and 2 is shown. In the embodiment of FIG. 6, the catalyst material 138 used to form the polycrystalline material 136 of a polycrystalline table 132B' may be substantially completely removed (e.g.; fully leached). In such embodiments, the second depth $D_2$ may be equal to the thickness T of the polycrystalline table 132W, the first portion 154 may occupy an entire volume of the polycrystalline table 132B', and the second portion 156 (see FIG. 5) may be absent. In some embodiments, substantially completely removing the catalyst material 138 from an entire polycrystalline table 132B' may cause the polycrystalline table 132B' to become detached from any substrate 134B (see FIG. 5) that was attached to the polycrystalline table 132W during formation of the polycrystalline table 132B'. In such embodiments, the polycrystalline table 132B' may be reattached to the substrate 134B (see FIG. 5) or attached to another substrate 134W, for example, by brazing.

Figure 7:
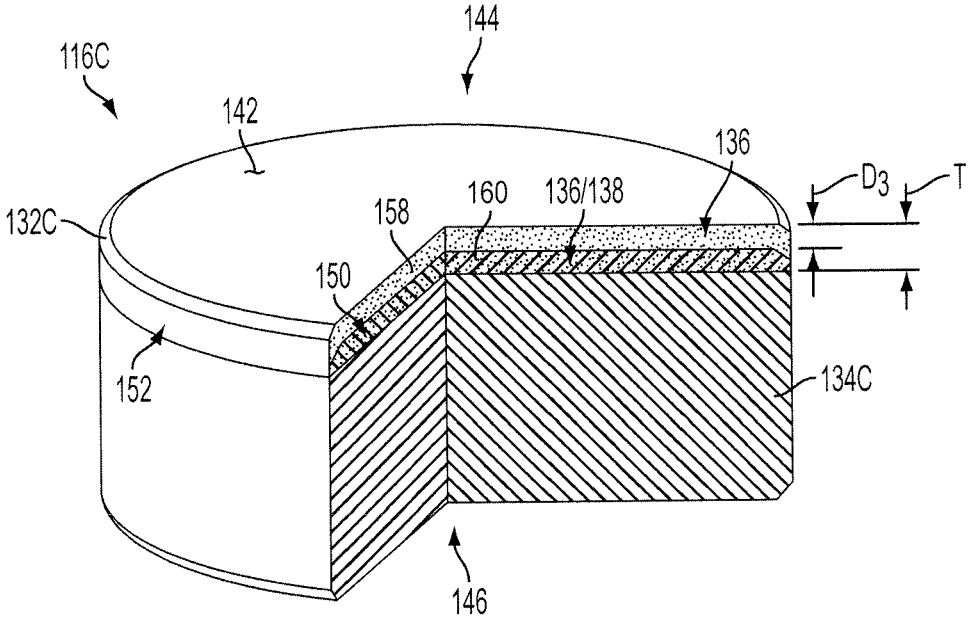
FIG. 7 is a perspective partial cross-sectional view of a cutting element from a third region of the earth-boring tool of FIGS. 1 and 2.

Referring to FIG. 7, a perspective partial cross-sectional view of a cutting element 116C from the third, nose region 128 of the earth-boring tool 100 of FIGS. 1 and 2 is shown. The cutting element 116C may comprise a polycrystalline table 132C secured to a substrate 134C. For example, the cutting element 116C may comprise a disk-shaped polycrystalline table 132C in contact with an end of a cylindrical substrate 134C and attached to the substrate 134C. The substrate 134C may comprise a hard material suitable for use in earth-boring applications. For example, the substrate 134C may comprise a ceramic-metallic composite material (i.e., a cermet) comprising particles of hard ceramic material (e.g., tungsten carbide) in a metallic matrix material (e.g., cobalt). The polycrystalline table 132C may comprise a polycrystalline material 136 characterized by grains of a superhard material (e.g., synthetic, natural, or a combination of synthetic and natural diamond, cubic boron nitride, etc.) that have bonded to one another to form a matrix of polycrystalline material 136 with interstitial spaces located among interbonded grains of the superhard material. The cutting element 116C may be formed using the processes described previously in connection with FIG. 3, and the polycrystalline table 132C may have the same resulting microstructure after formation.

Catalyst material 138 may be substantially completely removed from a portion 158 of the polycrystalline table 132C at and adjacent an exterior of the polycrystalline table to a third depth $D_3$ in some embodiments. For example, the catalyst material 138 may be substantially completely removed from a portion 158 having any of the configurations described previously for first portions 140 and 154 in connection with FIGS. 3 and 5. Accordingly, the polycrystalline table 132C may include a first portion 158 from which catalyst material 138 has been substantially completely removed and a second portion 160 in which the catalyst material 138 remains. Removal of the catalyst material 138 may be accomplished, for example, by leaching (e.g., by submerging the first portion 158 of the polycrystalline table 132C in a leaching agent, such as, for example, aqua regia) or other catalyst removal techniques known in the art.

The third depth $D_3$ may be between the first depth $D_1$ and the second depth $D_2$. Removing the catalyst material 138 to different depths $D_1$, $D_2$, and $D_3$ for different cutting elements 116A, 116B, and 116C to be located in different regions 124, 126, and 128 (see FIG. 2) of an earth-boring tool 100 (see FIGS. 1 and 2) may be accomplished, for example, by any of the processes discussed previously in connection with FIG. 5. The third depth $D_3$ may be between the first depth $D_1$ and the second depth $D_2$ and, for example, greater than about 25%, greater than about 40%, about 50%, less than about 60%, or less than about 75% of the entire thickness T of the polycrystalline table 132C. More specifically, the third depth $D_3$ may be between the first depth $D_1$ and the second depth $D_2$, and may be about 50 μm or more, about 75 μm or more, about 100 μm, about 125 μm or less, about 150 μm or less, about 250 μm or less, or about 500 μm or less. A ratio of the first depth $D_1$ to third depth $D_3$ and to the second depth $D_2$ ($D_1$:$D_3$:$D_2$) may be about 1:1.5:2, about 1:2.5:5, about 1:5:10, about 1:10:25, about 1:25:50, or about 1:50:100.

Referring collectively to FIGS. 2 through 7, each cutting element 116A in the cone region 124 may have catalyst material 138 removed from the polycrystalline table 132A thereof to the same depth $D_1$, each cutting element 116C in the nose region 128 may have catalyst material 138 removed from the polycrystalline table 132C thereof to the same depth $D_3$, and each cutting element 116B in the shoulder region 126 may have catalyst material 138 removed from the polycrystalline table 132B thereof to the same depth $D_2$, and depth may increase with distance from the rotational axis 112 region 124, 128, and 126 by region 124, 128, and 126 in some embodiments. In other embodiments, depth may increase with distance from the rotational axis 112 even within the regions 124, 128, and 126, such that individual cutting elements 116A, 116C, and 116B within a given region 124, 128, and 126 may have catalyst material 138 removed from the polycrystalline table 132A, 132C, and 132B thereof to differing depths $D_1$, $D_3$, and $D_2$. For example, depth may increase linearly, exponentially, or according to a Solow growth curve as distance from the rotational axis 112 increases. In still other embodiments, depth of catalyst removal may not bear any relation to distance from the rotational axis 112.

By removing catalyst material 138 from the polycrystalline tables 132A, 132C, and 132B of cutting elements 116A, 116C, and 116B located in different regions 124, 128, and 126 to differing depths $D_1$, $D_3$, and $D_2$, the cutting elements 116A, 116C, and 116B may be better tailored for use in the specific conditions present in the respective regions 124, 128, and 126. For example, wear resistance and thermal stability of a cutting element may increase and fracture toughness may decrease as the depth of catalyst removal increases, and regions of the crown 114 that may subject the cutting elements therein to greater abrasive wear and higher working temperatures, such as, for example, the nose region 128 and shoulder region 126, may have a longer useful life if the cutting elements 116C and 116B located therein have the catalyst material 138 removed from their associated polycrystalline tables 132C and 132B to a greater depth $D_3$ and $D_2$. By contrast, wear resistance and thermal stability of a cutting element may decrease and fracture toughness may increase as the depth of catalyst removal decreases, and regions of the crown 114 that may subject the cutting elements therein to less abrasive wear and lower working temperatures, such as, for example, the cone region 124 and nose region 128, may have a longer useful life if the cutting elements 116A and 116C located therein have the catalyst material 138 removed from their associated polycrystalline tables 132A and 132C to a smaller depth $D_1$ and $D_3$. In addition, time and cost of producing cutting elements increases as the depth of catalyst removal increases, and earth-boring tools 100 may be less expensive to produce if the cutting elements 116A and 116C located in regions of the crown 114 that may subject the cutting elements 116A and 116C therein to less abrasive wear and lower working temperatures, such as, for example, the cone region 124 and nose region 128, have the catalyst material 138 removed from their associated polycrystalline tables 132A and 132C to a smaller depth $D_1$ and $D_3$.

In addition to varying the depth to which catalyst material 138 is removed form the polycrystalline tables 132A, 132C, and 132B of cutting elements 116A, 116C, and 116B distributed over the crown 114 of an earth-boring tool 100, the depth to which catalyst material 138 is removed may vary from earth-boring tool to earth-boring tool. For example, catalyst material 138 may be removed from the polycrystalline tables 132A, 132C, and 132B of cutting elements 116A, 116C, and 116B secured to earth-boring tools that are planned for use in more abrasive environments (e.g., sandstone) to a greater average depth than a depth of catalyst material 138 removal from the polycrystalline tables 132A, 132C, and 132B of cutting elements 116A, 116C, and 116B secured to earth-boring tools that are planned for use in less abrasive environments (e.g., limestone). Such variation may enable earth-boring tools to be produced at lower costs, which may enable exploration and production to occur in areas that otherwise would not have been profitable.

Additional non-limiting embodiments encompassed by this disclosure include, but are not limited to:

Embodiment 1

An earth-boring tool comprises a body comprising a crown at a leading end of the body, the crown comprising a first region and a second region. The first region is located closer to a rotational axis of the body than the second region. A first cutting element located in the first region is secured to the body, the first cutting element comprising a first polycrystalline table secured to a first substrate. A second cutting element located in the second region is also secured to the body, the second cutting element comprising a second polycrystalline table secured to a second substrate. Each of the first polycrystalline table and the second polycrystalline table comprises interbonded grains of superhard material. The first polycrystalline table is substantially free of catalyst material to a first depth and the second polycrystalline table is substantially free of catalyst material to a second, greater depth.

Embodiment 2

The earth-boring tool of Embodiment 1, further comprising a third region interposed between the first region and the second region and a third cutting element located in the third region secured to the body, the third cutting element comprising a third polycrystalline table secured to a third substrate, wherein the third polycrystalline table comprises interbonded grains of superhard material and wherein the third polycrystalline table is substantially free of catalyst material to a third depth intermediate the first and second depths.

Embodiment 3

The earth-boring tool of Embodiment 1 or Embodiment 2, wherein a ratio of the first depth to the second depth is about 1:100 or less.

Embodiment 4

The earth-boring tool of any one of Embodiments 1 through 3, wherein the first depth is less than about 25% of an entire thickness of the first polycrystalline table.

Embodiment 5

The earth-boring tool of any one of Embodiments 1 through 4, wherein the first depth is about 100 μm or less.

Embodiment 6

The earth-boring tool of Embodiment 5, wherein the first depth is about 50 μm or less.

Embodiment 7

The earth-boring tool of any one of Embodiments 1 through 6, wherein the second depth is about 100 μm or greater.

Embodiment 8

The earth-boring tool of Embodiment 7, wherein the second depth is about 200 μm or greater.

Embodiment 9

The earth-boring tool of Embodiment 8, wherein the second polycrystalline table is substantially completely free of the catalyst material.

Embodiment 10

The earth-boring tool of any one of Embodiments 1 through 9, wherein the first region comprises a cone region at and around the rotational axis of the body and the second region comprises a shoulder region adjacent to and surrounding a nose region, the nose region being adjacent to and surrounding the cone region.

Embodiment 11

The earth-boring tool of Embodiment 10, wherein each polycrystalline table of each cutting element is substantially free of catalyst material to a depth, the depth increasing with distance from the rotational axis from the cone region to the shoulder region.

Embodiment 12

An earth-boring tool may comprise a body comprising a crown at a leading end of the body. The crown may comprise a cone region at and around a rotational axis of the body, a nose region adjacent to and surrounding the cone region, a shoulder region adjacent to and surrounding the nose region, and a gage region defining a periphery of the body adjacent to and surrounding the shoulder region. A first cutting element located in the cone region may be secured to the body. The first cutting element may comprise a first polycrystalline table secured to a first substrate. A second cutting element located in the shoulder region may be secured to the body. The second cutting element may comprise a second polycrystalline table secured to a second substrate. Each of the first polycrystalline table and the second polycrystalline table may comprise interbonded grains of superhard material. The first polycrystalline table is substantially free of catalyst material to a first depth and the second polycrystalline table is substantially free of catalyst material to a second, greater depth.

Embodiment 13

An earth-boring tool may comprise a body comprising a crown at a leading end of the body. The crown may comprise a cone region at and around a rotational axis of the body, a nose region adjacent to and surrounding the cone region, a shoulder region adjacent to and surrounding the nose region, and a gage region defining a periphery of the body adjacent to and surrounding the shoulder region. Cutting elements located in each of the cone region, the nose region, the shoulder region, and the gage region may be secured to the body. Each cutting element may comprise a polycrystalline table secured to a substrate. The polycrystalline table of each cutting element may comprise interbonded grains of superhard material. Each polycrystalline table of each cutting element is substantially free of catalyst material to a depth, the depth increasing with distance from the rotational axis from the cone region to the shoulder region.

Embodiment 14

A method of forming an earth-boring tool may comprise providing a first cutting element and a second cutting element, the first cutting element comprising a first polycrystalline table secured to a first substrate, the second cutting element comprising a second polycrystalline table secured to a second substrate, wherein each of the first polycrystalline table and the second polycrystalline table comprises interbonded grains of superhard material. Catalyst material used to catalyze formation of inter-granular bonds among the grains of superhard material may be removed from the first polycrystalline table to a first depth and from the second polycrystalline table to a second, greater depth. A body comprising a crown at a leading end of the body, the crown comprising a first region and a second region, the first region being located closer to a rotational axis of the body than the second region may be provided. The first cutting element may be secured to the body in the first region, and the second cutting element may be secured to the body in the second region.

Embodiment 15

The method of Embodiment 14, wherein the body further comprises a third region interposed between the first region and the second region and further comprising providing a third cutting element, the third cutting element comprising a third polycrystalline table secured to a third substrate, wherein the third polycrystalline table comprises interbonded grains of superhard material; removing catalyst material used to catalyze formation of inter-granular bonds between the grains of superhard material from the third polycrystalline table to a third, intermediate depth between the first and second depths; and securing the third cutting element to the body in the third region.

Embodiment 16

The method of Embodiment 14 or Embodiment 15, wherein removing the catalyst material to the first depth comprises removing the catalyst material to a first depth of less than about 25% of an entire thickness of the first polycrystalline table.

Embodiment 17

The method of any one of Embodiments 14 through 16, wherein removing the catalyst material to the first depth comprises removing the catalyst material to a first depth of about 100 μm or less.

Embodiment 18

The method of any one of Embodiments 14 through 17, wherein removing the catalyst material to the second depth comprises removing the catalyst material to a second depth of about 100 μm or greater.

Embodiment 19

The method of Embodiment 18, wherein removing the catalyst material to the second depth of about 100 μm or greater comprises substantially completely removing the catalyst material from the second polycrystalline table.

Embodiment 20

The method of any one of Embodiments 14 through 19, wherein providing the body comprising the crown, the crown comprising the first region and the second region, comprises providing the body comprising the crown, the crown comprising a cone region corresponding to the first region at and around the rotational axis of the body and a shoulder region corresponding to the second region adjacent to and surrounding a nose region, the nose region being adjacent to and surrounding the cone region.

Embodiment 21

The earth-boring tool of any one of Embodiments 14 through 20, wherein removing the catalyst material comprises leaching the catalyst material.

While certain illustrative embodiments have been described in connection with the figures, those of ordinary skill in the art will recognize and appreciate that the scope of the disclosure is not limited to those embodiments explicitly shown and described herein. Rather, many additions, deletions, and modifications to the embodiments described herein may be made to produce embodiments within the scope of the disclosure, such as those hereinafter claimed, including legal equivalents. In addition, features from one disclosed embodiment may be combined with features of another disclosed embodiment while still being within the scope of the disclosure, as contemplated by the inventors.

What is claimed is:

1. An earth-boring tool, comprising:

a body comprising a crown at a leading end of the body, the crown comprising a cone region at and around a rotational axis of the body, a nose region adjacent to and surrounding the cone region, a shoulder region adjacent to and surrounding the nose region, and a gage region defining a periphery of the body adjacent to and surrounding the shoulder region;

a first cutting element located in the cone region secured to the body, the first cutting element comprising a first polycrystalline table comprising interbonded grains of superhard material formed using a catalyst material and secured to a first substrate;

a second cutting element located in the nose region secured to the body, the second cutting element comprising a second polycrystalline table comprising interbonded grains of superhard material formed using a catalyst material and secured to a second substrate;

a third cutting element located in the shoulder region secured to the body, the third cutting element comprising a third polycrystalline table comprising interbonded grains of superhard material formed using a catalyst material and secured to a third substrate; and a fourth cutting element located in the gage region secured to the body, the fourth cutting element comprising a fourth polycrystalline table comprising interbonded grains of superhard material formed using a catalyst material and secured to a fourth substrate;

wherein the first polycrystalline table is substantially free of the catalyst material to a first depth, the second polycrystalline table is substantially free of the catalyst material to a second, greater depth, the third polycrystalline table is substantially free of the catalyst material to a third, still greater depth, and the fourth polycrystalline material is substantially free of catalyst material to a fourth, greatest depth, and wherein a rate at which depth increases from the first depth, through the second and third depths, to the fourth depth is at least substantially according to a Solow growth curve.

2. The earth-boring tool of claim 1, wherein the second depth is about 25% of an entire thickness of the second polycrystalline table or greater.

3. The earth-boring tool of claim 2, wherein the third depth is about 50% of the entire thickness of the third polycrystalline table or greater.

4. The earth-boring tool of claim 3, wherein the fourth polycrystalline table is substantially completely free of the catalyst material.

5. The earth-boring tool of claim 1, wherein a depth of removal of catalyst material of each polycrystalline table of each cutting element secured to the body increases with distance from the rotational axis from the cone region to the shoulder region at a rate according to a Solow growth curve.

6. An earth-boring tool, comprising:

a body comprising a crown at a leading end of the body, the crown comprising a cone region at and around a rotational axis of the body, a nose region adjacent to and surrounding the cone region, a shoulder region adjacent to and surrounding the nose region, and a gage region defining a periphery of the body adjacent to and surrounding the shoulder region;

a first cutting element located in the cone region secured to the body, the first cutting element comprising a first polycrystalline table secured to a first substrate;

a second cutting element located in the nose region secured to the body, the second cutting element comprising a second polycrystalline table secured to a second substrate;

a third cutting element located in the shoulder region secured to the body, the third cutting element comprising a third polycrystalline table secured to a third substrate; and a fourth cutting element located in the gage region secured to the body, the fourth cutting element comprising a fourth polycrystalline table secured to a fourth substrate; and wherein each of the first polycrystalline table, the second polycrystalline table, the third polycrystalline table, and the fourth polycrystalline table comprises interbonded grains of superhard material formed using a catalyst material and wherein the first polycrystalline table is substantially free of the catalyst material to a first depth, the second polycrystalline table is substantially free of the catalyst material to a second, greater depth of at least about 100 μm, and the third polycrystalline table is substantially free of the catalyst material to another, still greater depth, and the fourth polycrystalline table is substantially free of the catalyst material to a greatest depth and wherein a rate at which depth increases from the first depth, through the second and third depths, to the fourth depth is at least substantially according to a Solow growth curve.

7. A method of forming an earth-boring tool, comprising:

providing a first cutting element, a second cutting element, a third cutting element, and a fourth cutting element, the first cutting element comprising a first polycrystalline table secured to a first substrate, the second cutting element comprising a second polycrystalline table secured to a second substrate, the third cutting element comprising a third polycrystalline table secured to a third substrate, the fourth cutting element comprising a fourth polycrystalline table secured to a fourth substrate, wherein each of the first polycrystalline table, the second polycrystalline table, the third polycrystalline table, and the fourth polycrystalline table comprises interbonded grains of superhard material;

removing catalyst material used to catalyze formation of inter-granular bonds among the grains of superhard material from the first polycrystalline table to a first depth, removing catalyst material used to catalyze formation of inter-granular bonds among the grains of superhard material from the second polycrystalline table to a second, greater depth, removing catalyst material used to catalyze formation of inter-granular bonds among the grains of superhard material from the third polycrystalline table to a third, still greater depth, and removing catalyst material used to catalyze formation of inter-granular bonds among the grains of superhard material from the fourth polycrystalline table to a fourth, greatest depth, such that a rate at which depth increases from the first depth, through the second and third depths, to the fourth depth is at least substantially according to a Solow growth curve;

providing a body comprising a crown at a leading end of the body, the crown comprising a cone region at and around a rotational axis of the body, a nose region adjacent to and surrounding the cone region, a shoulder region adjacent to and surrounding the nose region, and a gage region defining a periphery of the body adjacent to and surrounding the shoulder region;

securing the first cutting element to the body in the cone region;

securing the second cutting element to the body in the nose region;

securing the third cutting element to the body in the shoulder region; and securing the fourth cutting element to the body in the gage region.

8. The method of claim 7, wherein removing the catalyst material to the second depth comprises removing the catalyst material to a depth of about 25% of an entire thickness of the second cutting element or greater.

9. The method of claim 8, wherein removing the catalyst material to the fourth depth comprises substantially completely removing the catalyst material from the fourth polycrystalline table.

10. The earth-boring tool of claim 7, wherein removing the catalyst material comprises leaching the catalyst material.

* * * * *